US005988237A

United States Patent [19]

Bedsole

[11] Patent Number: 5,988,237

[45] Date of Patent: Nov. 23, 1999

[54] MANUALLY OPERATED SANDBAG FILLING APPARATUS

[76] Inventor: Robert Bedsole, c/o Adcom Technologies, Incorporated, P.O. Box 658, Mount Prospect, Ill. 60056

[21] Appl. No.: 09/165,630

[22] Filed: Oct. 1, 1998

[51] Int. Cl.[6] ..... B65B 1/04

[52] U.S. Cl. ..... 141/231; 141/114; 141/313; 141/391

[58] Field of Search ..... 141/231, 114, 141/313–317, 391

[56] References Cited

U.S. PATENT DOCUMENTS

| | | | |
|---|---|---|---|
| 1,495,886 | 5/1924 | Craite . | |
| 1,700,405 | 1/1929 | Guidi . | |
| 3,552,346 | 1/1971 | Garden . | |
| 4,044,921 | 8/1977 | Caverly . | |
| 4,585,041 | 4/1986 | Cavanagh . | |
| 4,763,702 | 8/1988 | High, Jr. et al. . | |
| 4,819,701 | 4/1989 | Thornton . | |
| 5,215,127 | 6/1993 | Bergeron . | |
| 5,353,851 | 10/1994 | Cline | 141/313 |
| 5,396,753 | 3/1995 | Cullen . | |
| 5,425,403 | 6/1995 | Herrmann . | |
| 5,771,665 | 6/1998 | Nelson et al. . | |
| 5,802,807 | 9/1998 | Johnson | 141/391 |
| 5,901,762 | 5/1999 | Rollins | 141/313 |

*Primary Examiner*—Steven O. Douglas
*Attorney, Agent, or Firm*—Wood, Phillips, VanSanten, Clark & Mortimer

[57] ABSTRACT

A manually operated sandbag filling apparatus includes a frame and wheels rotatably mounted to the frame for moving the frame over a ground surface including into position proximate a supply of sand on the ground surface. Handles project from the frame for manually manipulating the frame into and out of the position. An auger drive is operatively mounted to the frame to convey sand on the ground surface to a discharge port. A power drive is mounted to the frame for driving the auger drive. A support table is provided for supporting a sandbag to be filled proximate the discharge port.

25 Claims, 6 Drawing Sheets

MANUALLY OPERATED SANDBAG FILLING APPARATUS

FIELD OF THE INVENTION

This invention relates to a sandbag filling apparatus and, more particularly, to a portable manually operated sandbag filling apparatus.

BACKGROUND OF THE INVENTION

A sandbag is typically used in emergency situations, such as during flooding conditions. Because of the lack of everyday use of sandbags, it is not normal to store already filled sandbags. Instead, if an emergency situation arises, then a load of sand is typically dumped proximate the area where the sandbags are needed. Empty bags are then filled on site.

During an emergency situation filling the bags quickly and easily is of utmost importance. One way of doing so is to manually shovel sand from a sand pile into the bags. While this is clearly the simplest way of filling the bags, it is also manually intensive and time consuming. Manual efforts are better spent placing the filled bags in position, rather than filling the bags themselves.

Various apparatus have been proposed for automatically filling sandbags. However, these are typically in the form of large machinery or devices for mounting on a truck. Due to the complexity of the machinery, they can be quite expensive. For an item that would normally be used very infrequently, it is difficult for individuals, municipalities or other governmental bodies to justify the expense. Also, such devices would necessarily need continued maintenance even when not in use. This further burdens purchasers for a device that would hopefully never be used.

The present invention is directed to overcoming one or more of the problems discussed above in a novel and simple manner.

SUMMARY OF THE INVENTION

In accordance with the invention there is provided a portable sandbag filling apparatus which is entirely manually operated.

Broadly, there is disclosed herein a manually operated sandbag filling apparatus including a frame and wheels rotatably mounted to the frame for moving the frame over a ground surface including into position proximate a supply of sand on the ground surface. Handle means project from the frame for manually manipulating the frame into and out of the position. Auger means operatively mounted to the frame convey sand on the ground surface to a discharge port. A power drive is mounted to the frame for driving the auger means. Means are provided for supporting a sandbag to be filled proximate the discharge port.

It is a feature of the invention that the frame comprises a shell rotatably supporting a primary auger. The shell includes a collection hopper and the primary auger is rotatable to deliver sand on the ground surface to the collection hopper. The auger means further comprises a lift auger mounted to the frame, the discharge port being part of the lift auger, for conveying sand from the collection hopper to the discharge port.

It is a feature of the invention that the auger means comprises a primary auger and a secondary auger, and the primary auger conveys sand on the ground surface to the secondary auger, which conveys sand to the discharge port.

It is another feature of the invention that the power drive comprises an engine driving an output shaft. A gear box connects the output shaft to the auger means. The power drive further includes a first gear box operatively connecting the output shaft to the primary auger, and a second gear box operatively connecting the output shaft to the secondary auger.

It is another feature of the invention to provide a discharge chute mounted proximate the discharge port. The discharge chute comprises an articulated discharge chute.

It is still another feature of the invention that the supporting means comprises a table for supporting a sandbag and a hook extending from the table, the hook being receivable in an aperture associated with the sandbag. Means are provided for adjustably mounting the table proximate the discharge chute to vary an angle of the table relative to the ground surface to control amount of sand filled in a sandbag. A latch hook is mounted to the support means for catching a snag loop on a sandbag to restrain a filled sandbag falling from the support means to close the bag. The latch hook comprises a spring loaded latch hook.

It is still another feature of the invention that the power drive comprises means for driving the wheels.

It is yet another feature of the invention that the control means is mounted to the handle means for controlling operation of the auger means. The control means comprises a hand grip control.

Further features and advantages of the invention will be readily apparent from the specification and from the drawing.

DETAILED DESCRIPTION OF THE INVENTION

Figure 1:
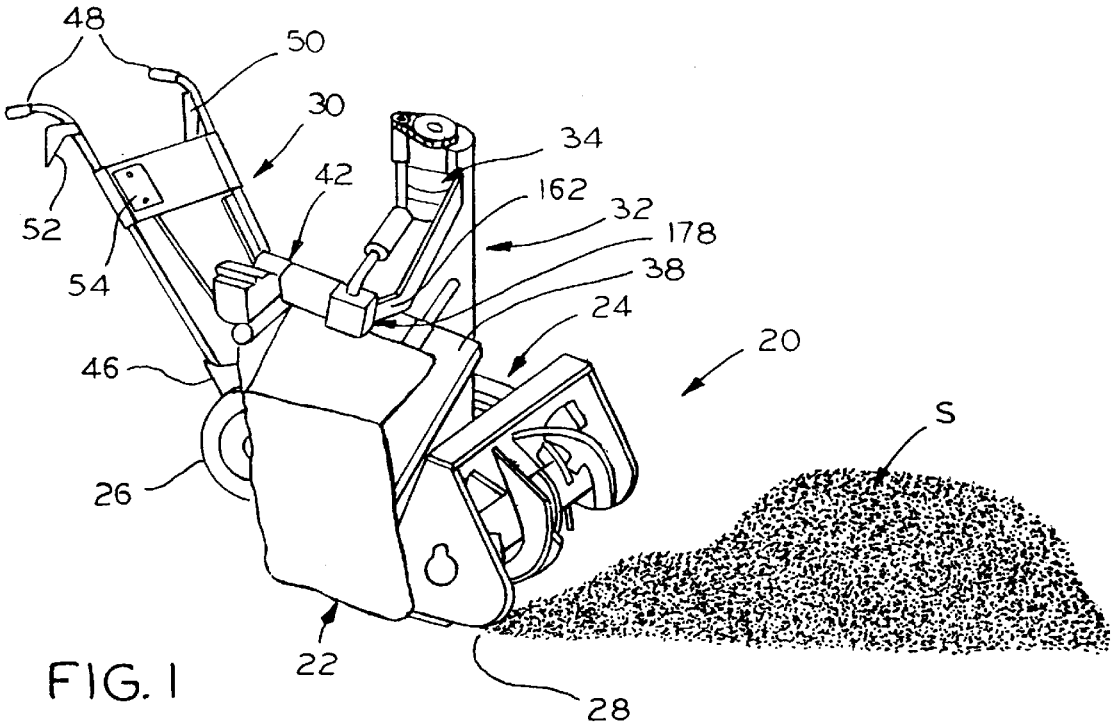
FIG. 1 is a perspective view of a sandbag filling apparatus according to the invention.
Figure 2:
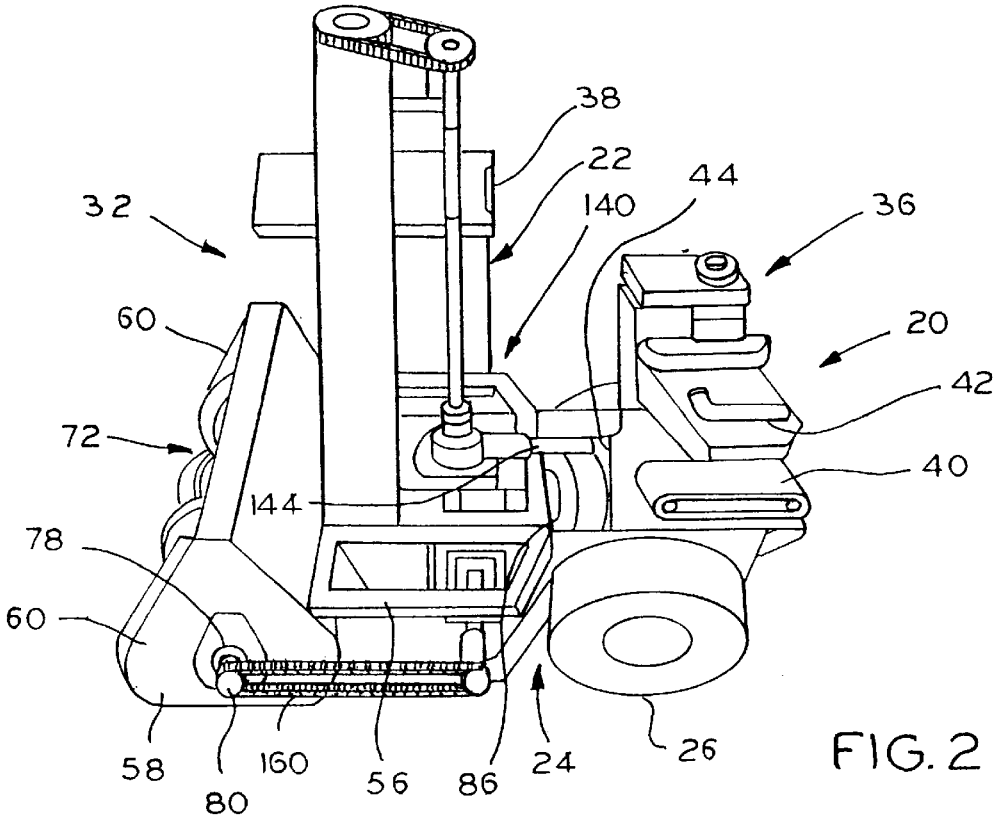
FIG. 2 is a partial side view of the sandbag filling apparatus of FIG. 1.

Referring to FIGS. 1 and 2, a sandbag filling apparatus 20 according to the invention is illustrated. The sandbag filling apparatus 20 is portable and entirely manually operated by a single user for quickly and easily filling sandbags 22 with sand. Moreover, the apparatus 20 is intended to be supplied at a relatively low cost and of a compact size.

The apparatus 20 comprises a frame 24. Wheels 26 are rotatably mounted to the frame 24 for moving the frame 24 over a ground surface 28 including into position proximate a supply of sand S on the ground surface 28. A handle assembly 30 projects from the frame 24 for manually manipulating the frame 24 and thus the apparatus 20 into and out of the position proximate the supply of sand S. An auger system 32 is mounted to the frame 24 and conveys sand on the ground surface 28 to a discharge port 34. A power drive 36 is mounted to the frame 24 for driving the auger assembly 32. A support table 38 is mounted proximate the discharge port 34 for supporting the sandbags 22 while being filled.

In accordance with the invention, the power drive 36 comprises a self-propelled power unit. The power drive 36 includes a housing 40 which forms part of the frame 24. A gasoline engine 42 is mounted to the housing 40 for developing motive power to drive an output shaft 44. The handle assembly 30 is pivotally mounted to the housing as at 46. The handle assembly 30 includes dual handlebars 48. A left-hand grip control 50 controls self-propulsion of the wheels 26 in a conventional manner. A right-hand grip control 52 controls the auger drive 32 as will be described hereinafter. A speed control 54 selects one of three forward speeds or reverse, for driving the self-propelled wheels 26.

Figure 3:
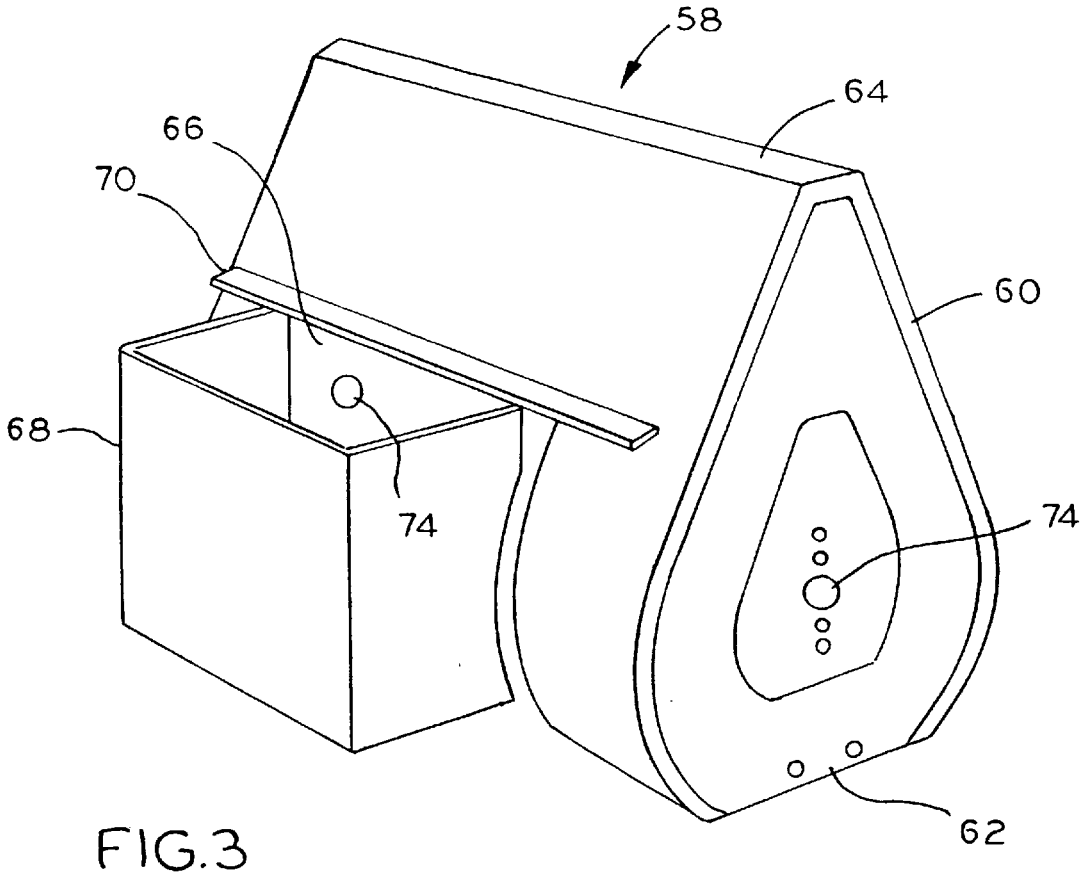
FIG. 3 is a rear perspective view of an auger shell of the apparatus of FIG. 1.
Figure 4:
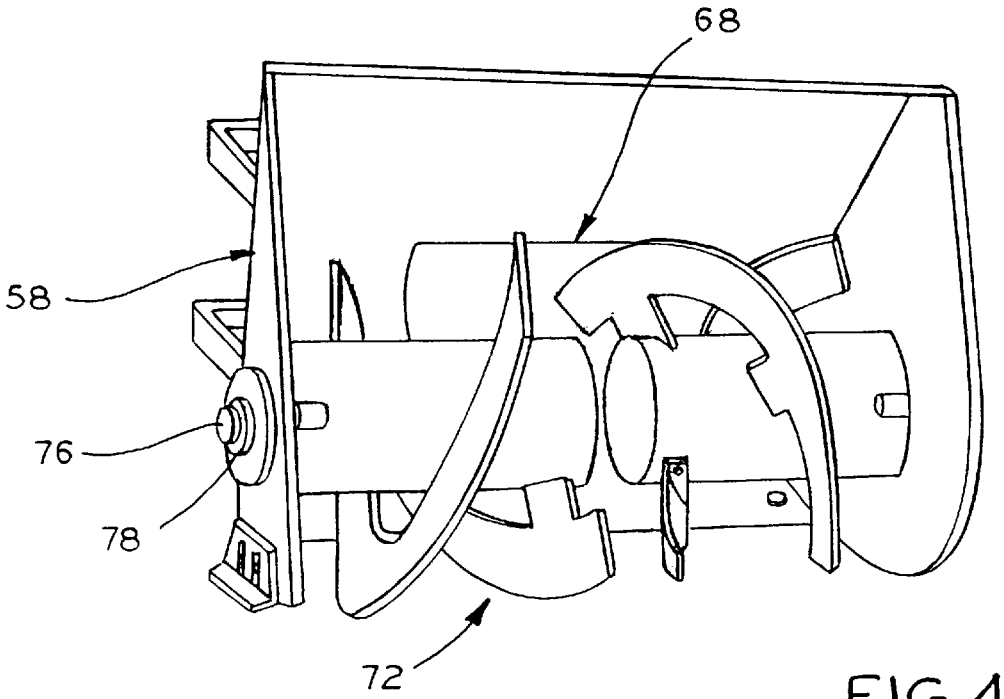
FIG. 4 is a front perspective view of a primary auger and hopper subassembly of the apparatus of FIG. 1.

The frame 24 further comprises an intermediate frame 56 and a primary auger shell 58. The primary auger shell 58 is illustrated in detail in FIG. 3. The primary auger shell 58 includes opposite, generally teardrop-shaped, side walls 60 having straight bottom edges 62 for riding along the ground surface. The side walls 60 are connected by a rear wall 64 curved to match the side walls 60. A central portion of the rear wall 64 is open, as illustrated at 66, and is in communication with a collection hopper 68. A stiffening rib 70 is mounted to the rear wall 64 above the collection hopper 68. Referring also to FIG. 4, a primary auger 72 is rotationally mounted to the primary auger shell 58 at opposite side wall openings 74, see FIG. 3. The primary auger 72 is of conventional construction and includes an axle 76 journaled in a bearing assembly 78 mounted to each side wall 60 proximate the opening 74. A chain sprocket 80 is secured to the axle 76 at the left side, as shown in FIG. 2, for driving the primary auger 72.

The primary auger 72 rotates in a direction into the page at the auger bottom, referring to FIG. 4. The primary auger 72 is operable to convey sand on the ground surface 28 into the collection hopper 68.

Figure 5:
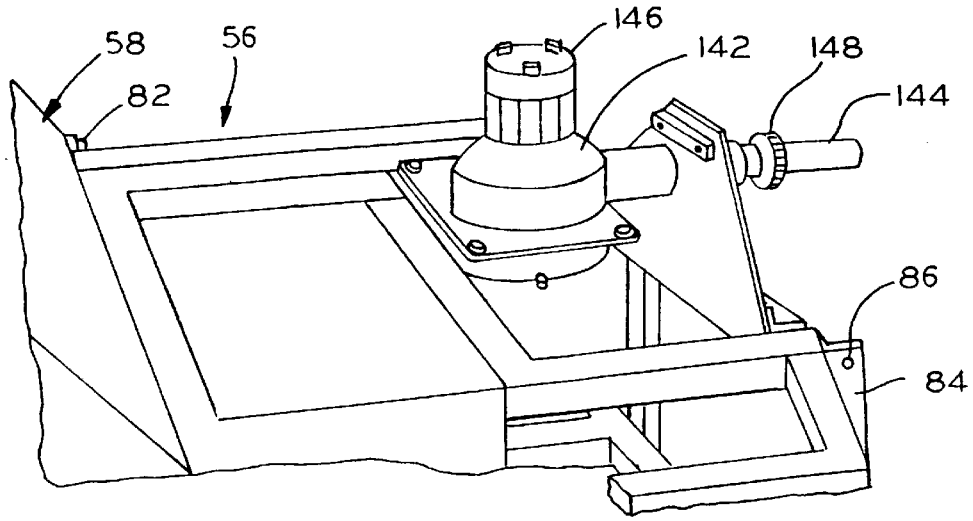
FIG. 5 is a side perspective view of a secondary auger right angle gear box mounted proximate the auger shell.

Referring to FIG. 5, the intermediate frame 56 is illustrated. The intermediate frame 56 is of metal tubular construction for mounting the primary auger shell 58 spaced from the power drive 36. Particularly, the intermediate frame 56 is mounted to the primary auger shell 58 using fasteners 82. Rear brackets 84 have openings 86 for fastening the intermediate frame 56 to the power drive housing 40 using threaded fasteners 88, see FIG. 2.

Figure 6:
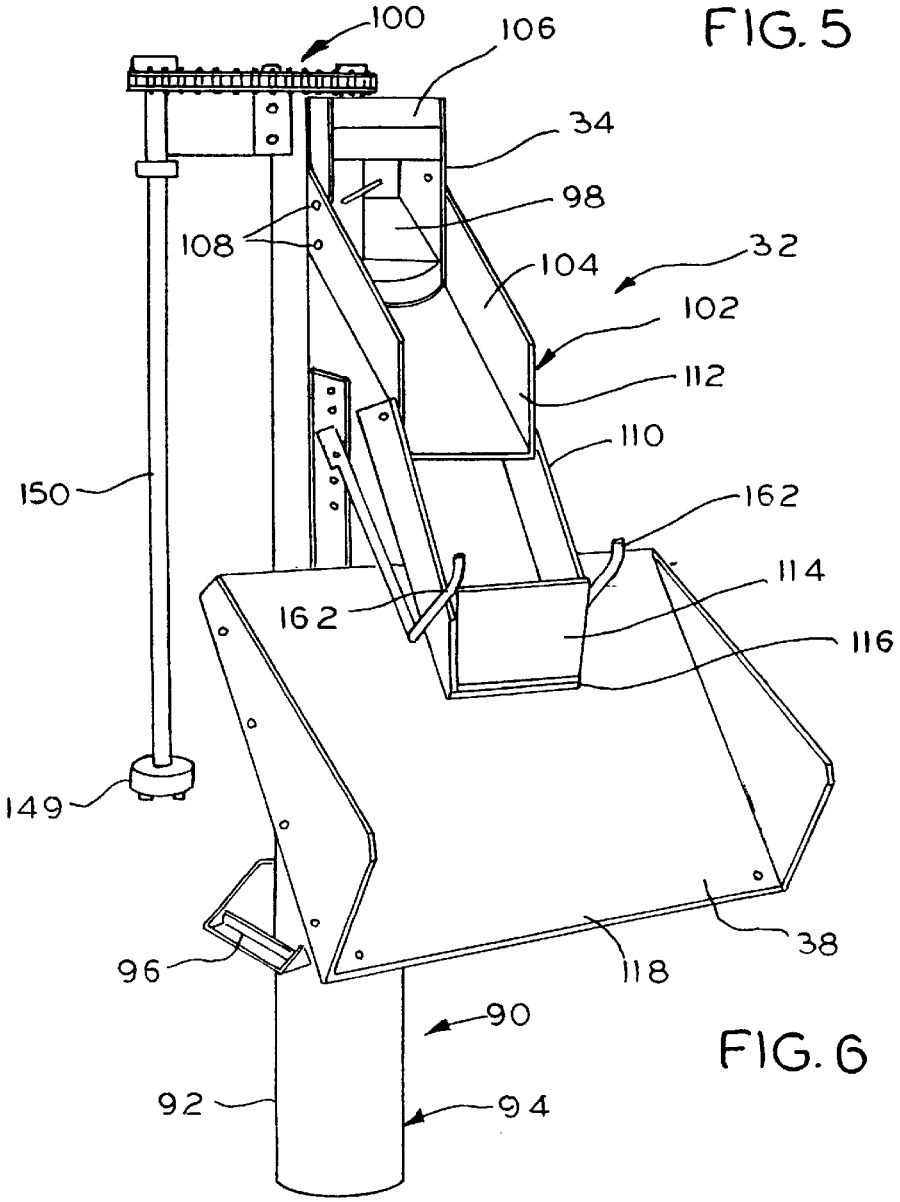
FIG. 6 is a perspective view of a secondary auger assembly of the apparatus of FIG. 1.

Referring to FIG. 6, a secondary or lift auger assembly 90 forming part of the auger drive 32 is illustrated. The secondary auger assembly 90 includes a vertical cylinder 92 having a bottom opening 94 defining an inlet port positioned below a bracket 96. The bracket 96 mounts the cylinder 92 to the intermediate frame 56 with the opening 94 positioned within the collection hopper 68. The discharge port 34 is located at the top of the cylinder 92. A secondary or lift auger 98 is rotatably mounted in the cylinder 92. The lift auger 98 is operated by a chain drive 100 to convey sand from the inlet port 94 vertically upwardly to the discharge port 34.

An articulated discharge chute 102 is mounted to the cylinder 92 proximate the discharge port 34. Particularly, the discharge chute 102 comprises an upper chute 104 bolted to a bracket 106, surrounding the discharge port 34, using fasteners 108. A lower chute 110 is hingedly mounted to the upper chute 104 using pins 112. A top plate 114 is affixed to the lower chute 110 to provide an opening 116 for delivering sand into the sandbag. The opening 116 is positioned proximate the open end of a sandbag to be filled. The top plate 114 concentrates and directs flow of sand into the open end of the sandbag. As the sandbag fills, the open end is pulled open by weight of the sand and is held open until the sandbag drops from the table 38, as discussed below. The articulated chute 102 is illustrated in a lowered position for operation in FIG. 6. Although not shown, the lower chute 110 can be pivoted upwardly about the hinge pins 112 in a raised position for loading empty bags onto the support table 38.

Figure 9:
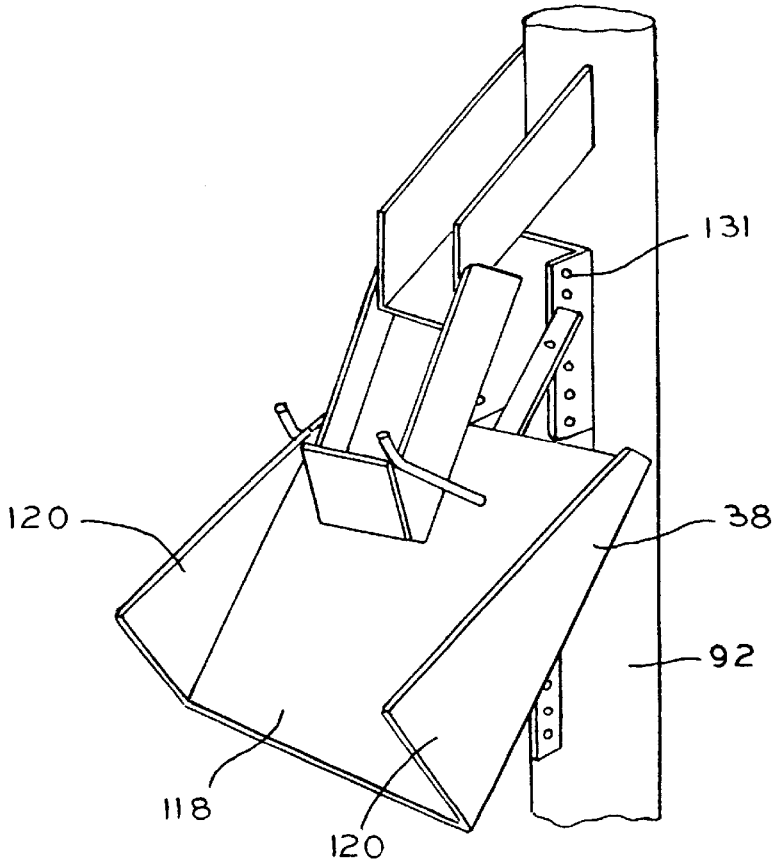
FIG. 9 is a side view illustrating a bag fill weight control used for lighter bag fill.
Figure 10:
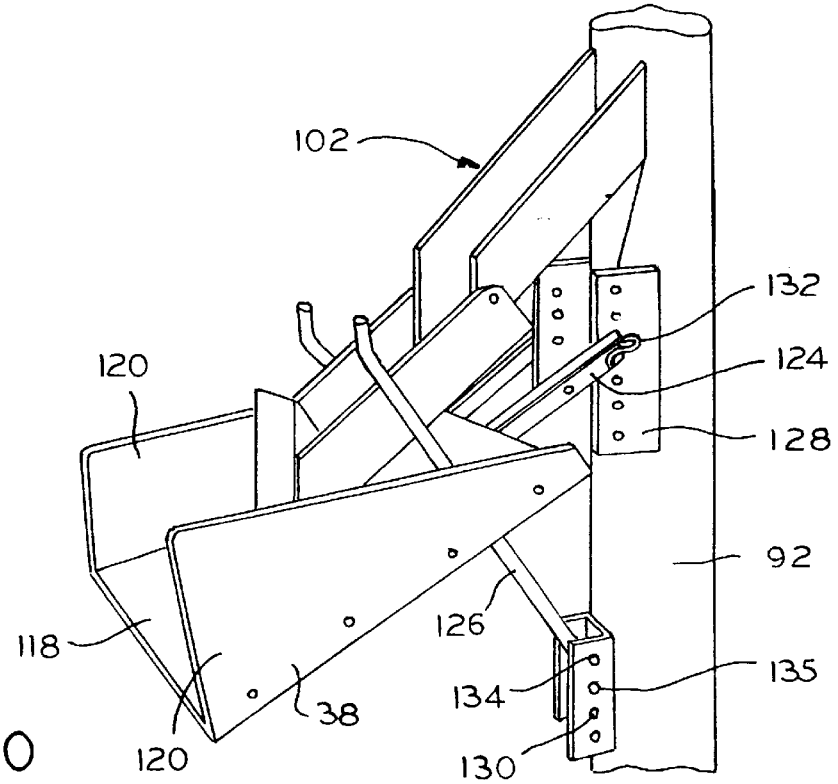
FIG. 10 is a side elevation view illustrating the bag fill weight control for heavier bag fill.

Referring also to FIGS. 9 and 10, the support table 38 comprises a bottom wall 118 and opposite side walls 120. A fixed arm 124 is fixedly secured to and extends rearwardly from the bottom wall 118. A bar 126 is hingedly mounted to the underside of the bottom wall 118. First and second adjustment brackets 128 and 130 are mounted to the cylinder 92 below the discharge chute 102. The bracket 128 is positioned above the bracket 130. The brackets 128 and 130 mount to the arm 124 and the bar 126, respectively, to provide for lighter or heavier bag fill by adjusting the vertical orientation of the table 38. Particularly, the fixed arm 124 is mounted to select vertical spaced openings 131 in the upper bracket 128 using cotter pins 132. An elongate pin 134 extends through select vertically spaced openings 135 in the bracket 130 and an opening in the bar 126 for adjusting its position and angular orientation of the support table 38. With the table in a more vertical position, as illustrated in FIG. 9, sandbags will drop earlier to provide lighter bag fill. With the table in a more horizontal position, as illustrated in FIG. 10, the bags will drop later, providing for heavier bag fill.

Referring to FIG. 2, a gear drive system 140 is illustrated. The gear drive system 140 is operable to drive the primary auger 72 and the secondary auger 98 from the motor output shaft 44.

Figure 7:
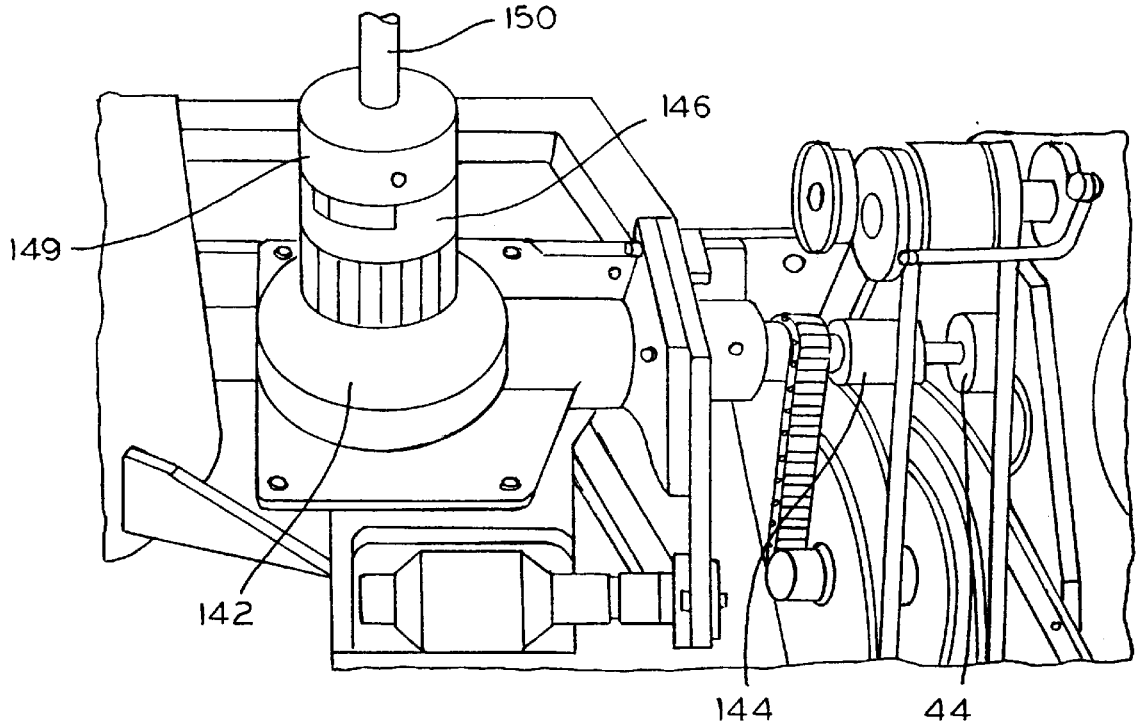
FIG. 7 is a side perspective view illustrating auger drive train operation for the apparatus of FIG. 1.

Referring also to FIGS. 5 and 7, a secondary auger right angle gear box 142 is connected to the intermediate frame 56. The right angle gear box 142 has an input shaft 144 which is operatively coupled to the motor output shaft 44. The right angle gear box 142 drives an output coupler 146. A sprocket 148 is provided on the input shaft 144. A driven coupler 149 mates with the output coupler 146 and drives a shaft 150. As shown in FIG. 6, the shaft 150 extends vertically and drives the chain drive 100, which in turn drives the secondary auger 98. Thus, motive power from the engine output shaft 44 is delivered through the input shaft 144 to the right angle gear box 142, which in turn drives the drive shaft 150 to operate the secondary auger 98.

Figure 8:
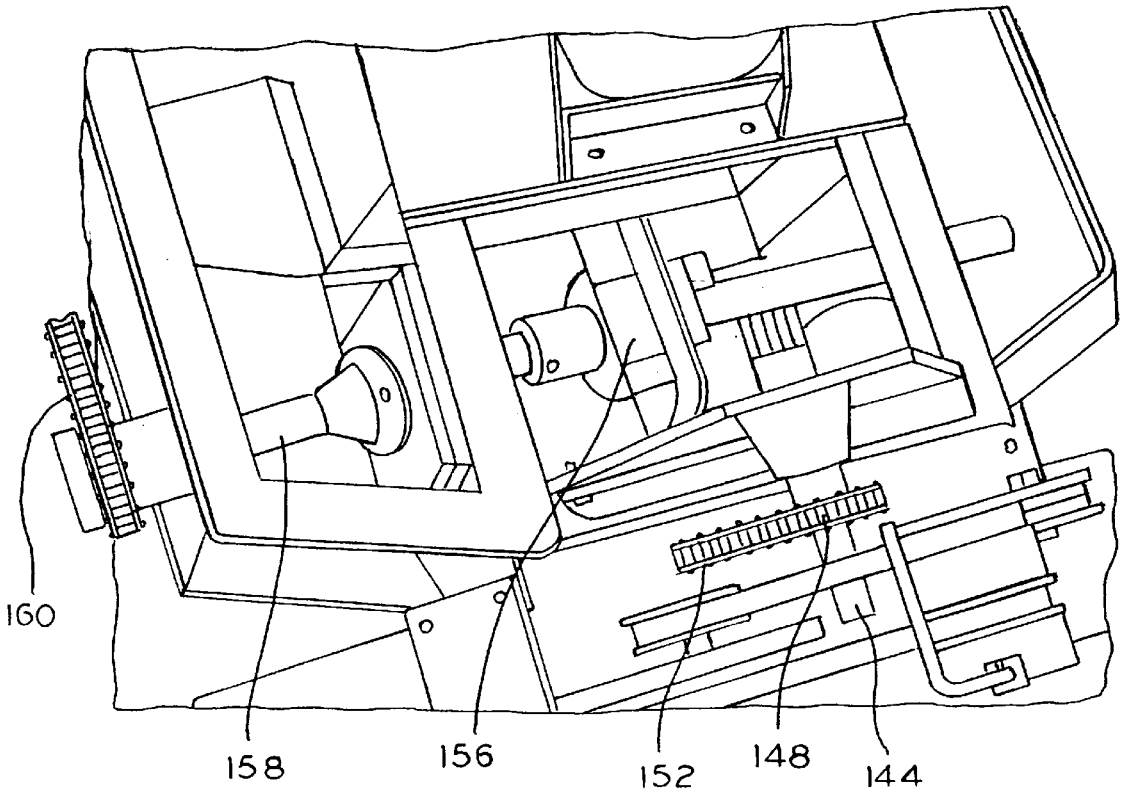
FIG. 8 is a perspective view illustrating a primary auger right angle gear box of the apparatus of FIG. 1.

Referring to FIG. 8, a chain 152 extends about the sprocket 148. The chain 152 in turn drives an input shaft of a primary auger right angle gear box 156. The right angle gear box 156 drives an elongate output shaft 158, which in turn drives a chain 160. The chain 160 is connected to the primary auger sprocket 80, see FIG. 2. Thus, power from the motor output shaft 44 is delivered through the shaft 144 to drive the chain 152 which, through the right angle gear box 156, drives the chain 160 to drive the primary auger 72.

Thus, in accordance with the invention, the right-hand grip control 52, see FIG. 1, is operated to engage the motor output shaft 44 to drive the primary auger 72 and the secondary auger 98. The primary auger 72 conveys sand from the ground surface 28 to the collection hopper 68. The secondary auger 98 lifts sand from the collection hopper 68 to the discharge port 34, and thus into the discharge chute 102 to fill sandbags 22, see FIG. 1.

More particularly, a single user can manually move the apparatus 20 into position proximate a supply of sand S. This can be done by manually pushing the apparatus 20 using the wheels 26, or using the self-propulsion feature of the wheels 26. The augers 72 and 98 are then operated to automatically fill sandbags 22.

Also, the system is further adapted to quickly and easily fill sandbags, one at a time, with the sandbags automatically being dropped and closed upon filling to a select desired weight.

Figure 11:
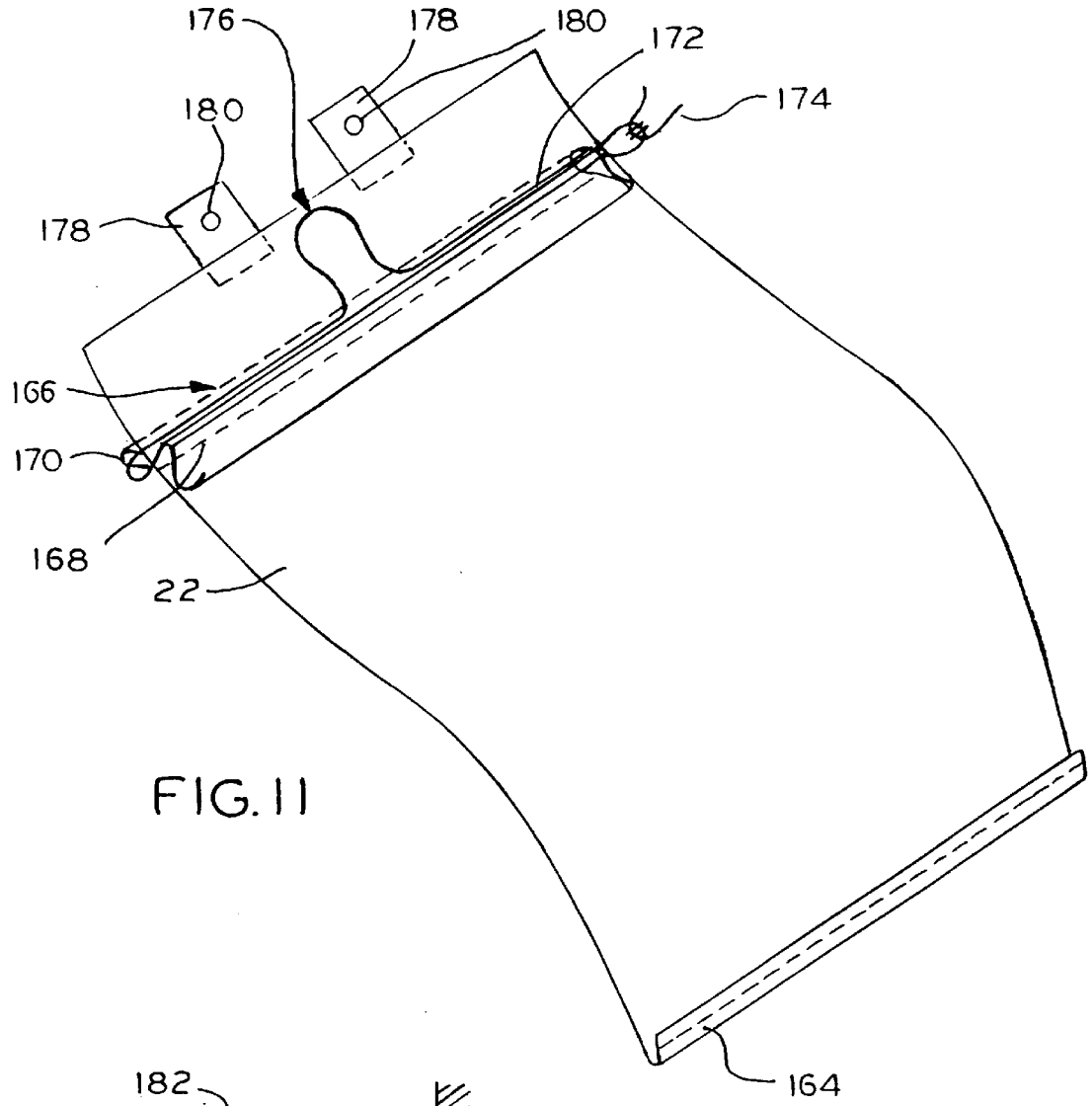
FIG. 11 is a perspective view of a sandbag used with the apparatus of FIG. 1.
Figure 12:
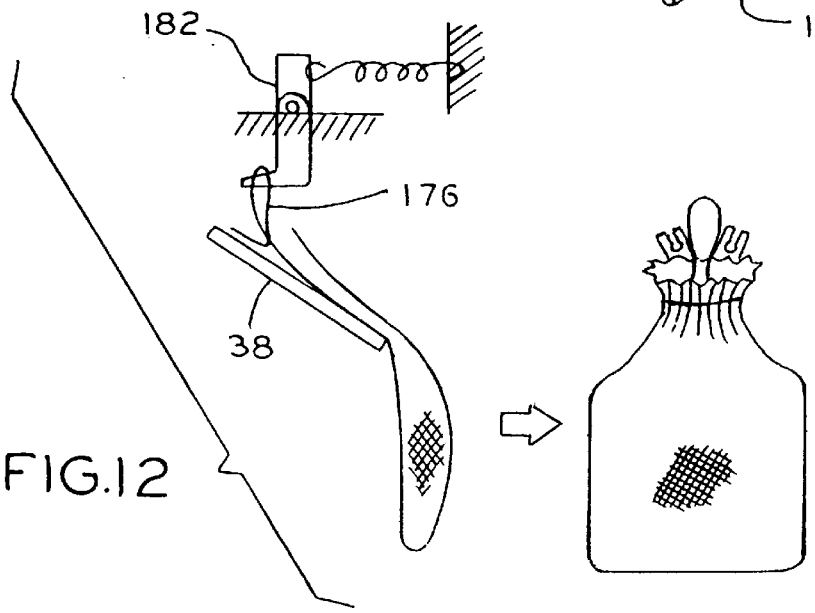
FIG. 12 is a schematic illustrating a procedure for closing the sandbag of FIG. 11 using the apparatus of FIG. 1.

Referring to FIG. 6, extending upwardly from the support table bottom wall 118 are opposite hanger pins or hooks 162. Particularly, one hanger pin 162 is provided on either side of the discharge chute 102. Referring to FIG. 11, a sandbag 22 according to the invention is illustrated. The bag 22 comprises a standard woven poly sandbag closed at a bottom via stitching 164. An opening 166 is provided at the top with hem loops 168 and 170 on the front and back of the bag, respectively. A cord 172 extends through the hem loops 168 and 170 and is knotted at 174. The cord 172 is longer than the hem loops 168 and 170 to provide a snagging loop 176. Paperboard card stock shear tabs 178 are attached to the bag 22 on either side of the snagging loop 176 above the hem loops 168 and 170. Each shear tab 178 includes an opening 180. The spacing between the openings 180 is selected so that the openings 180 receive the hanger pins 162 with the sandbag 22 positioned on the support table 118, as shown in FIG. 1.

The shear tabs 178 suspend an empty bag 22 from the bag table hanger pins 162, prior to and during fill, as shown in FIG. 1. The shear tabs will fail predictably and repeatably from the holes 180 upwardly. The load capacity of the shear tabs 178 is determined by the thickness of the stock and the dimension between the opening 180 and a top of the shear pad. Thus, when a bag reaches a predetermined weight, as determined in part by the orientation of the table 118 as discussed above relative to FIGS. 9 and 10, the shear tabs break way and the sandbag 22 falls to the ground. In accordance with the invention, means are provided for automatically closing the sandbag 22. Particularly, the snagging loop 176 is caught by a springloaded hook 182 hingedly mounted on the table 38 or the chute 102. When the sandbag 22 drops, the snagging loop 176 is restrained, causing the open end of the bag to be gathered and cinched, as illustrated. The spring action will cause the hook 182 to then release the bag 22.

In accordance with the invention, a plurality of bags, such as, for example, fifty bags 22 can be bundled for easy loading onto the hanger pins 162. The uppermost of the bags will be filled first. Once filled, the bag will drop away, leaving the open end 166 of the next bag proximate the discharge chute opening 116 to be filled in the same manner.

Thus, in accordance with the invention there is described a portable manually operated sandbag filling apparatus.

I claim:

1. A manually operated sandbag filling apparatus comprising:

a frame;

wheels rotatably mounted to the frame for moving the frame over a ground surface including into position proximate a supply of sand on the ground surface;

handle means projecting from the frame for manually manipulating the frame into and out of said position;

auger means operatively mounted to the frame for conveying sand on the ground surface to a discharge port;

a power drive mounted to the frame for driving the auger means; and means for supporting a sandbag to be filled proximate the discharge port.

2. The sandbag filling apparatus of claim 1 wherein the frame comprises a shell rotatably supporting a primary auger.

3. The sandbag filling apparatus of claim 2 wherein the shell includes a collection hopper and the primary auger is rotatable to deliver sand on the ground surface to the collection hopper.

4. The sandbag filling apparatus of claim 3 wherein the auger means comprises a lift auger mounted to the frame, the discharge port being part of the lift auger, for conveying sand from the collection hopper to the discharge port.

5. The sandbag filling apparatus of claim 1 wherein the auger means comprises a primary auger and a secondary auger, and the primary auger conveys sand on the ground surface to the secondary auger which conveys sand to the discharge port.

6. The sandbag filling apparatus of claim 1 wherein the power drive comprises an engine driving an output shaft.

7. The sandbag filling apparatus of claim 6 wherein the power drive further comprises a gear box connecting the output shaft to the auger means.

8. The sandbag filling apparatus of claim 6 wherein the auger means comprises a primary auger and a secondary auger, and the primary auger conveys sand on the ground surface to the secondary auger which conveys sand to the discharge port.

9. The sandbag filling apparatus of claim 8 wherein the power drive further comprises a first gear box operatively connecting the output shaft to the primary auger and a second gear box operatively connecting the output shaft to the secondary auger.

10. The sandbag filling apparatus of claim 1 further comprising a discharge chute mounted proximate the discharge port.

11. The sandbag filling apparatus of claim 10 wherein the discharge chute comprises an articulated discharge chute.

12. The sandbag filling apparatus of claim 1 wherein the supporting means comprises a table for supporting a sandbag and a hook extending from the table, the hook being receivable in an aperture associated with the sandbag.

13. The sandbag filling apparatus of claim 12 further comprising means for adjustably mounting the table proximate the discharge chute to vary an angle of the table relative to the ground surface to control amount of sand filled in a sandbag.

14. The sandbag filling apparatus of claim 12 further comprising a latch hook mounted to the support means for catching a snag loop on a sandbag to restrain a filled sandbag falling from the support means to close the bag.

15. The sandbag filling apparatus of claim 14 wherein the latch hook comprises a spring loaded latch hook.

16. The sandbag filling apparatus of claim 1 wherein the power drive further comprises means for driving the wheels.

17. The sandbag filling apparatus of claim 1 further comprising control means mounted to the handle means for controlling operation of the auger means.

18. The sandbag filling apparatus of claim 17 wherein the control means comprises a hand grip control.

19. The sandbag filling apparatus of claim 1 wherein the sandbag comprises a bag having an open top end and a shear tab extending upwardly from the open end, the shear tab having an aperture, the supporting means comprising a hook receivable in the aperture, the shear tab breaking to release the sandbag responsive to a preselect weight of the sandbag.

20. The sandbag filling apparatus of claim 19 wherein the select weight is determined by a distance between the aperture and a top of the shear tab.

21. The sandbag filling apparatus of claim 19 wherein the shear tab is of paperboard construction.

22. The sandbag filling apparatus of claim 19 wherein the select weight is determined by a thickness of the shear tab.

23. The sandbag filling apparatus of claim 1 wherein the sandbag is closed at a bottom and open at a top with hem loops on a front and back of the bag receiving a cord to be gathered and cinched to close the bag.

24. The sandbag filling apparatus of claim 23 wherein the cord is longer than the hem loops to provide a snagging loop.

25. The sandbag filling apparatus of claim 24 further comprising a latch hook mounted to the support means for catching the snag loop on the sandbag to restrain the filled sandbag falling from the support means to close the bag.

* * * * *